US007110561B2

(12) United States Patent
Kam

(10) Patent No.: US 7,110,561 B2
(45) Date of Patent: Sep. 19, 2006

(54) TRANSPARENT PANEL-FORM LOUDSPEAKER

(75) Inventor: Tai-Yan Kam, Hsin Chu (TW)

(73) Assignee: Neosonica Technologies, Inc., Taipei Hsien (TW)

( * ) Notice: Subject to any disclaimer, the term of this patent is extended or adjusted under 35 U.S.C. 154(b) by 899 days.

(21) Appl. No.: 09/989,604

(22) Filed: Nov. 20, 2001

(65) Prior Publication Data

US 2002/0118847 A1 Aug. 29, 2002

(30) Foreign Application Priority Data

Dec. 28, 2000 (TW) ..... 89128185 A

(51) Int. Cl.
*H04R 25/00* (2006.01)

(52) U.S. Cl. ..... 381/152; 381/431; 29/594; 29/592.1; 29/609.1

(58) Field of Classification Search ..... 29/594, 29/592.1, 609.1; 381/152, 431
See application file for complete search history.

(56) References Cited

U.S. PATENT DOCUMENTS 5,818,950 A * 10/1998 Sakamoto et al. ..... 381/420

2002/0027999 A1* 3/2002 Azima et al. ..... 381/431

* cited by examiner

*Primary Examiner*—Vivian Chin
*Assistant Examiner*—Justin Michalski
(74) *Attorney, Agent, or Firm*—Volpe and Koenig, P.C.

(57) ABSTRACT

A transparent panel-form loudspeaker consists of a transparent sound radiation panel that can radiate sound with desired pressure level over a specific frequency range when subjected to the flexural vibration induced by a preselected number of transducers located at specific positions on the peripheral edge of the transparent sound radiation panel and a rigid frame carrying a flexible suspension device which supports the periphery of the transparent sound radiation panel. The transparent sound radiation panel is made of a kind of transparent materials with the ratio of elastic modulus to density in the range from 3 to 180 GPa/(g/cm$^3$) and the ratio of length to thickness of the transparent sound radiation panel in the range from 80 to 600. The flexible suspension device supporting the periphery of the transparent sound radiation panel is used to modify the vibrational characteristics of the transparent sound radiation panel for an effective generation of the vibrational normal modes which are beneficial for sound radiation. The transducers are situated at predetermined locations on the peripheral edge of the transparent sound radiation panel so that relatively high radiation efficiency and more uniform spread of sound pressure level spectrum can be produced by the transparent sound radiation panel over a desired operative acoustic frequency range.

2 Claims, 25 Drawing Sheets

TRANSPARENT PANEL-FORM LOUDSPEAKER

FIELD OF THE INVENTION

The invention relates to a panel-form loudspeaker utilizing a transparent sound radiation panel that can generate beneficial and effective vibrational normal modes for radiating sound with desired pressure level over a specific frequency range.

BACKGROUND OF THE INVENTION

The invention relates to a transparent panel-form loudspeaker utilizing a preselected number of transducers to excite a peripherally supported transparent panel to generate beneficial flexural vibrational mode shapes for radiating sound with desired pressure level over a specific frequency range. Conventional loudspeakers utilizing a cone-type membrane as a sound radiator have been widely used. The sound radiation of the conventional loudspeaker is achieved by attaching an electrodynamic type voice coil transducer to the smaller end of the cone-type membrane and using the transducer to drive the cone-type membrane to move back and forth. In general, an enclosure is necessary to prevent low-frequency waves from the rear of the loudspeaker, which are out of phase with those from the front, from diffracting around to the front and interfering destructively with the waves from the front. The existence of such enclosure makes the loudspeaker cumbersome, weighty, having dead corner for sound radiation and etc. The shortcomings of the conventional loudspeakers together with the impact of the rapid growth of flat display devices such as LCD and Plasma TV have led to the intensive development of panel-form loudspeakers in recent years and many proposals of making panel-form loudspeakers have thus been resulted. For instance, Watters used the concept of coincidence frequency, where the speed of flexural wave in panel matches the speed of sound in air, to design a light and stiff strip element of composite structure that can sustain flexural waves and produce a highly directional sound radiation over a specified frequency range. The opaqueness, highly directional sound radiation, and geometry of the long radiating panel have limited the applications of this type of panel-form loudspeakers. Heron designed a panel-from loudspeaker which had a resonant multi-mode radiation panel. The radiation panel was a skinned composite with a honeycomb core. At its corner there was a transducer used for exciting the plate to generate multi-modal flexural vibration with frequencies above the fundamental and coincidence frequencies of the panel and provide, hopefully, high sound radiation efficiency. The design of such radiating panel, however, makes it so stiff that it requires a very large and cumbersome moving-coil driver to drive the panel and its overall efficiency from the viewpoint of electrical input is even less than the conventional loudspeakers. Again the radiating panel of such loudspeaker is opaque and its applications are also limited. Recently, Azima et al have adopted the method of multi-modal flexural vibration in designing a panel-form loudspeaker with some specific ratios of length to width. In contrast to Heron's design, the transducer in this case is placed at a specific point near the center of the panel. The location of the transducer on the panel is chosen in such a way that the transducer is not situated at any of the nodal lines of the first 20 to 25 resonant modes and all the natural frequencies that have been excited in the selected frequency range are uniformly distributed. Although the panel-form loudspeakers designed using this method can produce sound with wider frequency range than those using the other previously proposed methods, there are still some shortcomings that may limit the applications of this panel-form loudspeakers. One of such shortcomings is that the near center location of the transducer can hinder viewers from seeing through the radiating panel even though the panel itself is transparent. Another major shortcoming of the panel-form loudspeaker is the existence of severe fluctuations in the spectrum of sound pressure level. For a panel under vibration, there may be several thousand resonant modes with frequencies falling in the range from 50 to 20 KHz. If the location of the transducer is merely determined using the first 20 to 25 resonant modes, it will be inevitable that some resonant modes in the middle and high frequency ranges will be over- or under-excited and this may lead to the formations of unfavourable peaks and pits in the sound pressure level spectrum of the panel-form loudspeaker. It also worths pointing out that another source contributing to the severe fluctuations in the sound pressure level spectrum is the interference of sound waves radiated from different regions on the panel radiator. For a vibrating panel, the sound waves radiated from the convex and concave regions on the panel surface are out-of-phase and can cause interference among them. If the sound interference of the panel vibrating at a specific frequency is serious, the sound pressure level at that frequency will be significantly lowered and thus cause a pit in the sound pressure level spectrum. The aforementioned difficulties, however, were not tackled by Azima et al. Therefore, in view of the shortcomings existing in the panel-form loudspeakers, it is apparent that the previously proposed methods for the design of the existing panel-form loudspeakers can only find limited applications and are unsuitable to be used in the design of transparent panel-form loudspeakers.

Recently, the rapid growth of flat display and mobile communication devices such as liquid crystal display (LCD) monitors, cellular phones and personal digital assistants (PDA) in usage have roused the urgent need for the research and development of transparent panel-form loudspeakers. Since the integration of transparent panel-form loudspeakers with flat display and mobile communication devices can greatly enhance the performance of such devices, it thus becomes important to have a method that can be used to design the desired transparent panel-form loudspeaker for the devices. In order to meet the need in the development of transparent panel-form loudspeaker, a method for the design of a transparent panel-form loudspeaker of high efficiency is presented in this invention. The detail descriptions of the method and the making of such transparent panel-form loudspeaker are given in the subsequent sections.

SUMMARY OF THE INVENTION

It is, therefore, a principal object of the present invention to provide a transparent panel-form loudspeaker which can produce a desired sound pressure level spectrum over a predetermined frequency range. The transparent panel-form loudspeaker includes a thin transparent sound radiation panel made of transparent materials, a preselected number of transducers situated at specific locations on the peripheral edge of the transparent sound radiation panel, a flexible suspension device used to support the peripheral edge of the transparent sound radiation panel, and a rigid frame used to carry the flexible suspension device. Sound quality and radiation efficiency of the transparent panel-form loudspeaker over a desired acoustic frequency range are dependent on values of particular parameters of the transparent panel-form loudspeaker, including the ratio of elastic modulus to density, the ratio of length to thickness of the transparent sound radiation panel, and locations of the transducers and supporting points of the flexible suspension device on the peripheral edge of the transparent sound radiation panel. A proper selection of the values of the parameters can produce the required achievable sound pressure level spectrum of the transparent panel-form loudspeaker for operation over a desired acoustic frequency range.

Another object of the invention is to provide a method for designing a transparent panel-form loudspeaker which includes a transparent sound radiation panel, a number of transducers mounted at specific locations on the peripheral edge of the transparent sound radiation panel, a flexible suspension device supporting the peripheral edge of the panel, and a rigid frame for carrying the flexible suspension device. Optimal values of the parameters of the transparent panel-form loudspeaker, including the ratio of elastic modulus to density, the ratio of length to thickness of the transparent sound radiation panel, and locations of the transducers and supporting points of the suspension device on the peripheral edge of the transparent sound radiation panel, are selected in the design process to achieve the required sound pressure level spectrum of the transparent panel-form loudspeaker for operation over a desired acoustic frequency range.

The present invention may best be understood through the following descriptions with reference to the accompanying drawings, in which:

BRIEF DESCRIPTIONS OF THE DRAWINGS

FIGS. 1*a* and 1*b* are, respectively, illustrations of the front and rear views of a transparent panel-form loudspeaker with an electrodynamic type transducer mounted on the peripheral edge of the panel radiator;

FIG. 2 is an illustration of a transparent panel-form loudspeaker with two electrodynamic type transducers mounted on the peripheral edge of the panel radiator;

FIGS. 3*a* and 3*b* are typical sections in the directions of the length and width of the panel speaker of FIG. 1, respectively, showing a continuous soft plastic-impregenated corrugated cloth and several discrete foam plastic pads used in supporting the peripheral edge of said transparent panel-form loudspeaker;

FIG. 4 is another typical section of FIG. 1 showing a continuous soft plastic-impregnated corrugated cloth and several tension wires used in sustaining the peripheral edge of the transparent panel-form loudspeaker;

FIG. 5*a* is an illustration of the configuration of a round-shaped electrodynamic transducer;

FIG. 5*b* is a typical section of the electrodynamic transducer of FIG. 5*a;*

FIG. 6*a* is an illustration of the configuration of a blade-like electrodynamic transducer;

FIG. 6*b* is a typical section of the blade-like electrodynamic transducer of FIG. 6*a;*

FIG. 6*c* is an illustration of the voice coil unit of the blade-like electrodynamic transducer of FIG. 6*a;*

Figure 11A:
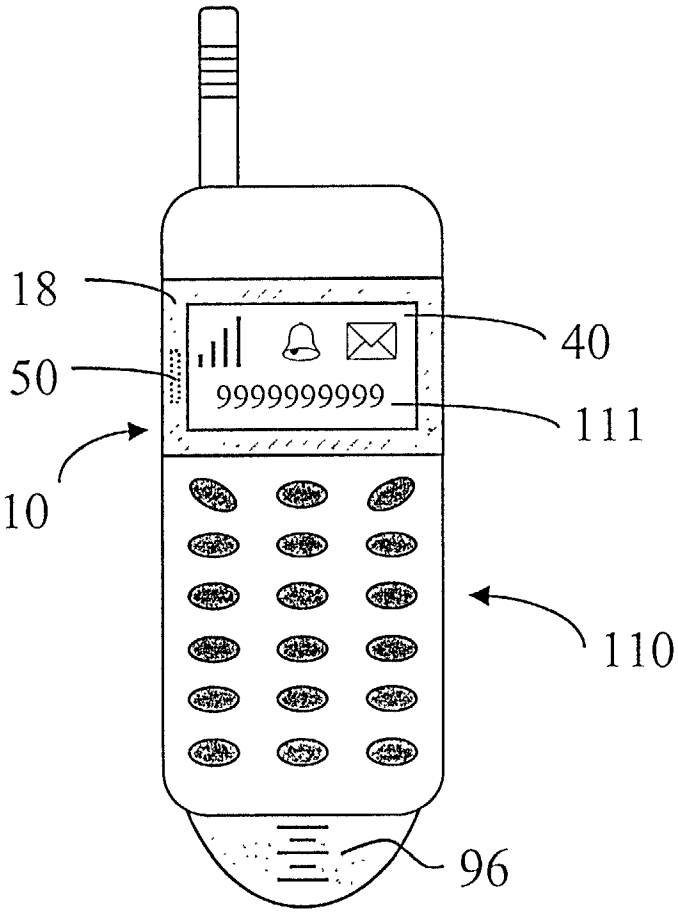
Figure 11B:
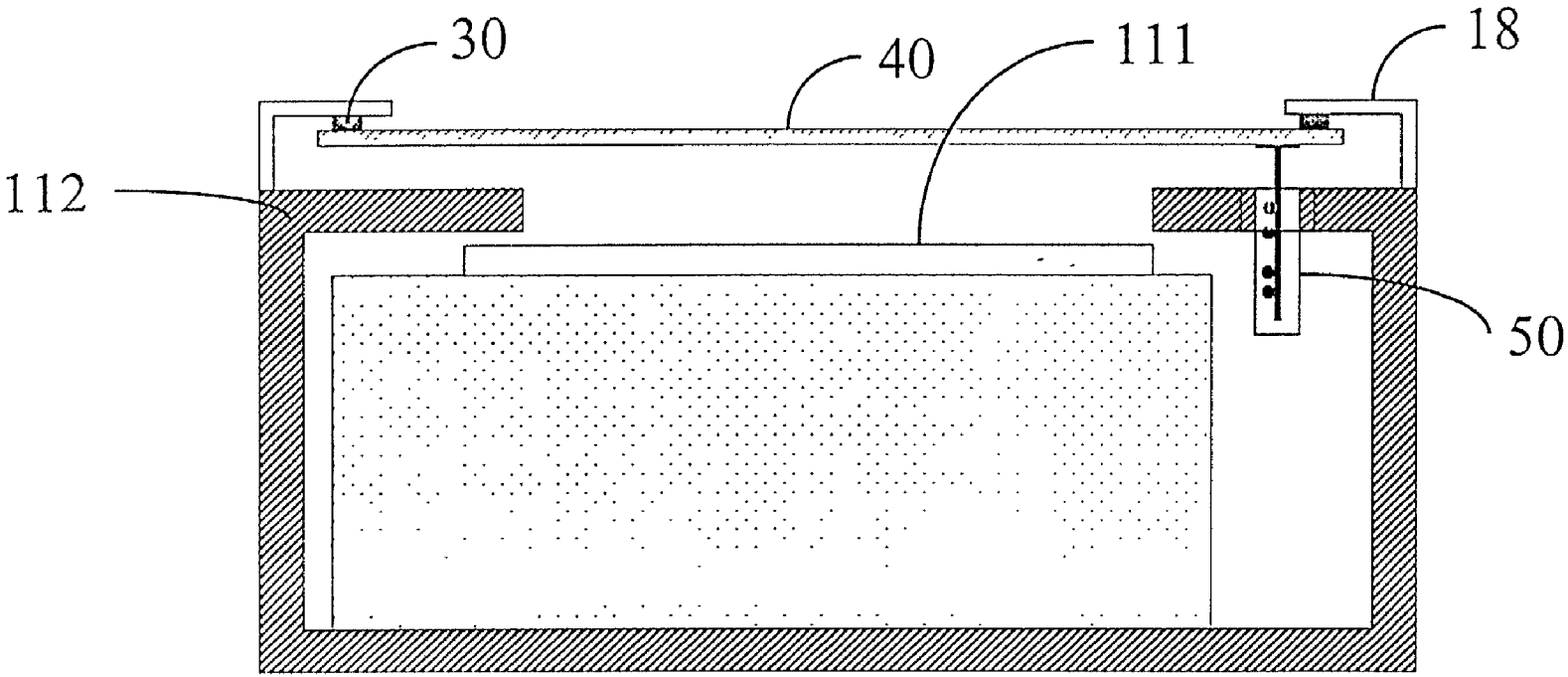
Figure 11C:
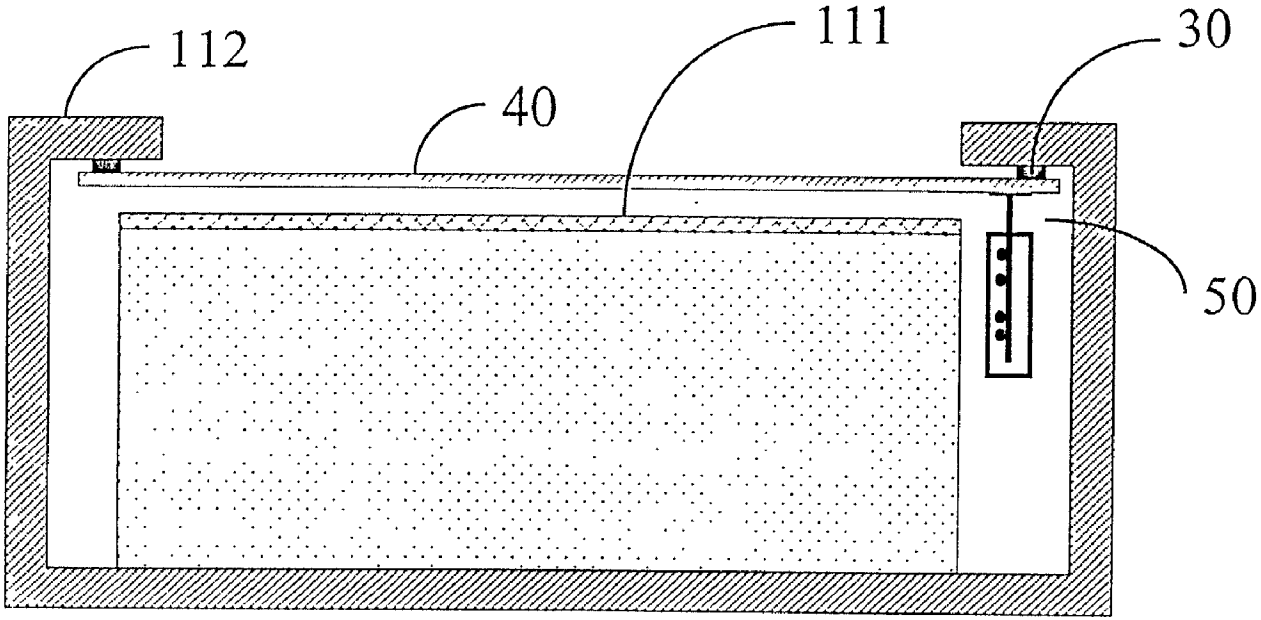
Figure 12:
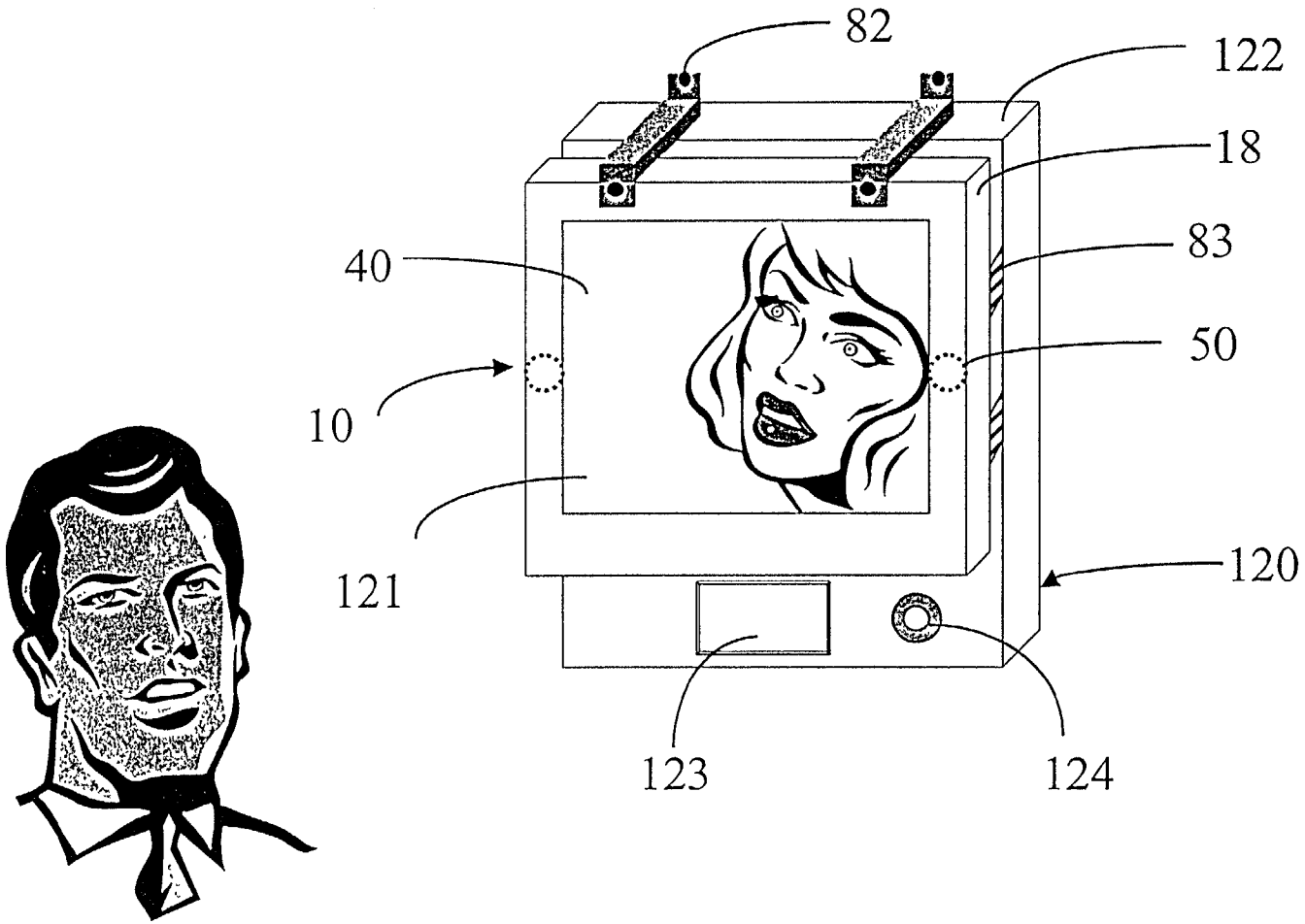
Figure 13A:
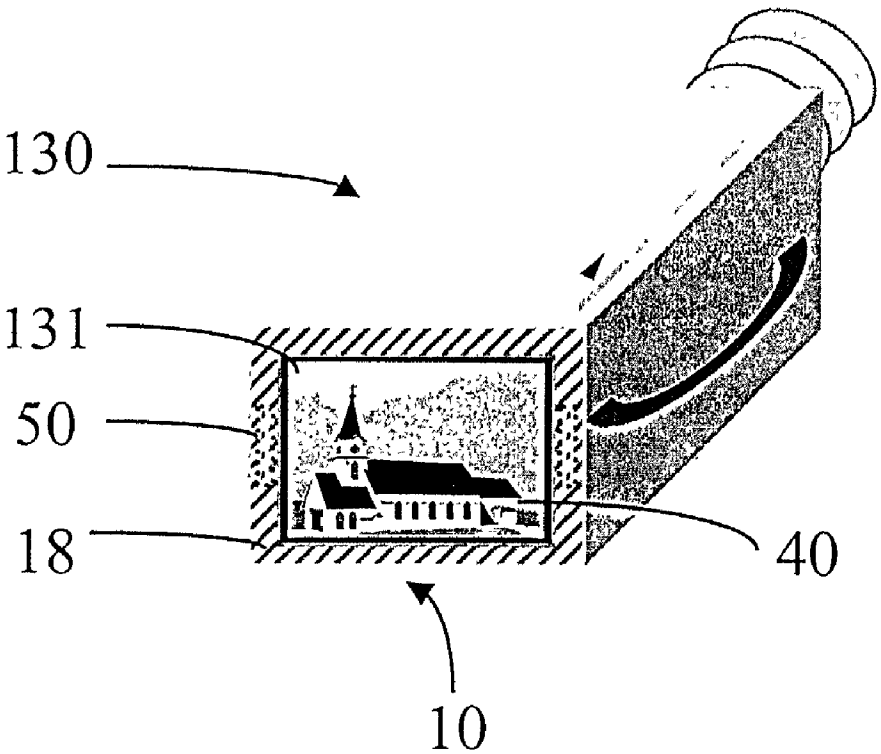
Figure 13B:
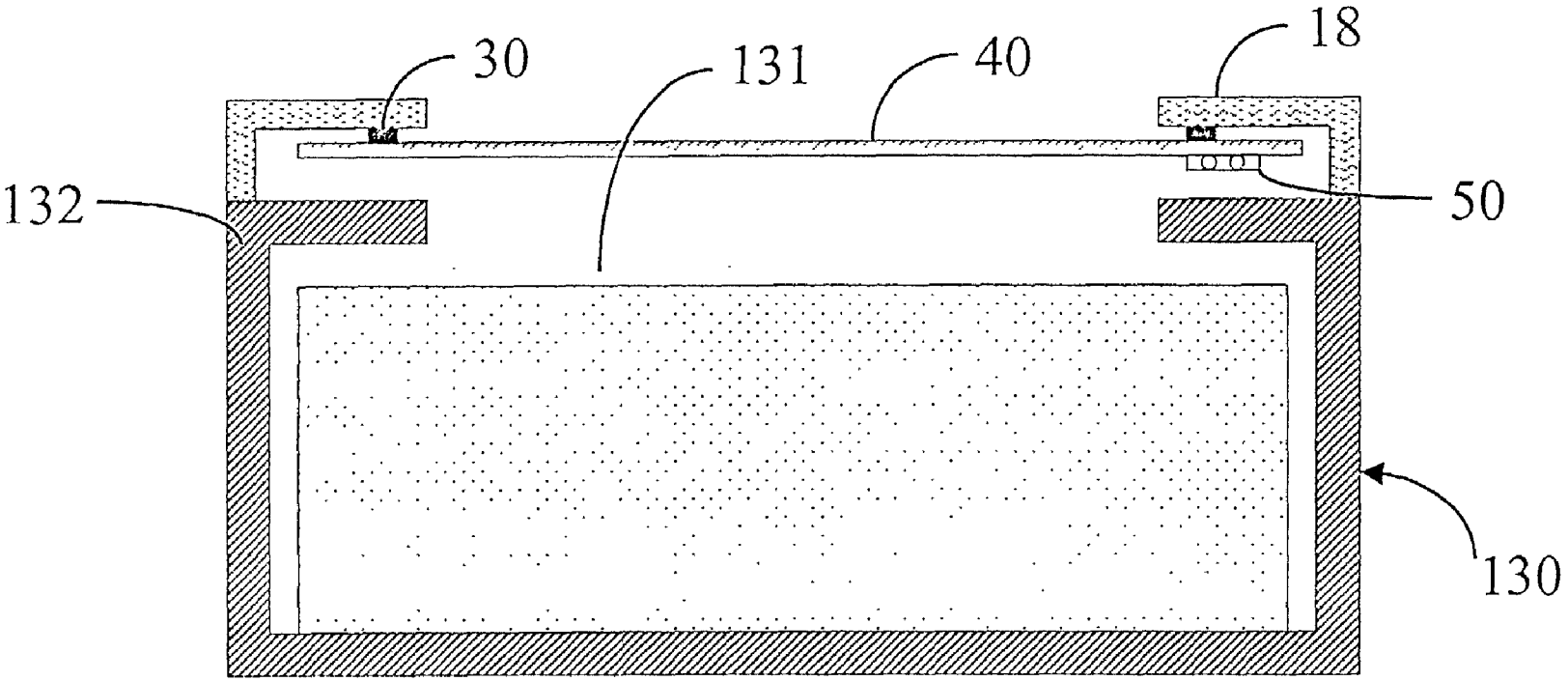
Figure 13C:
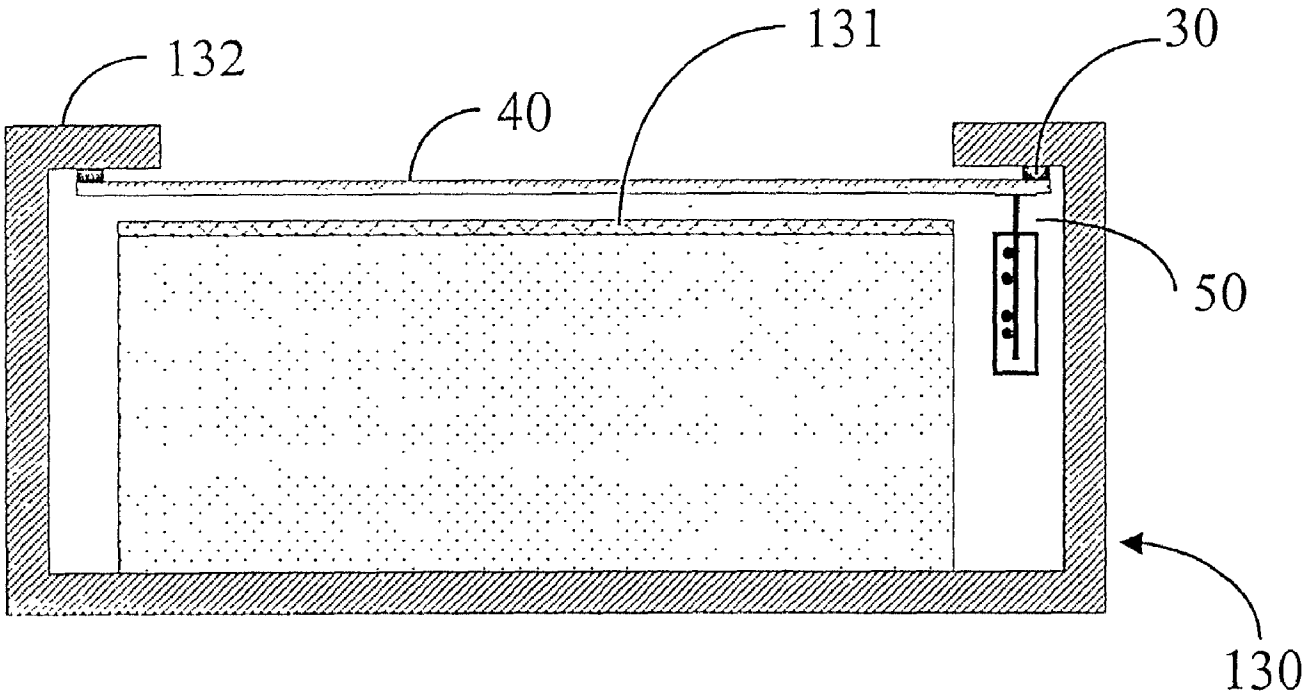
Figure 14A:
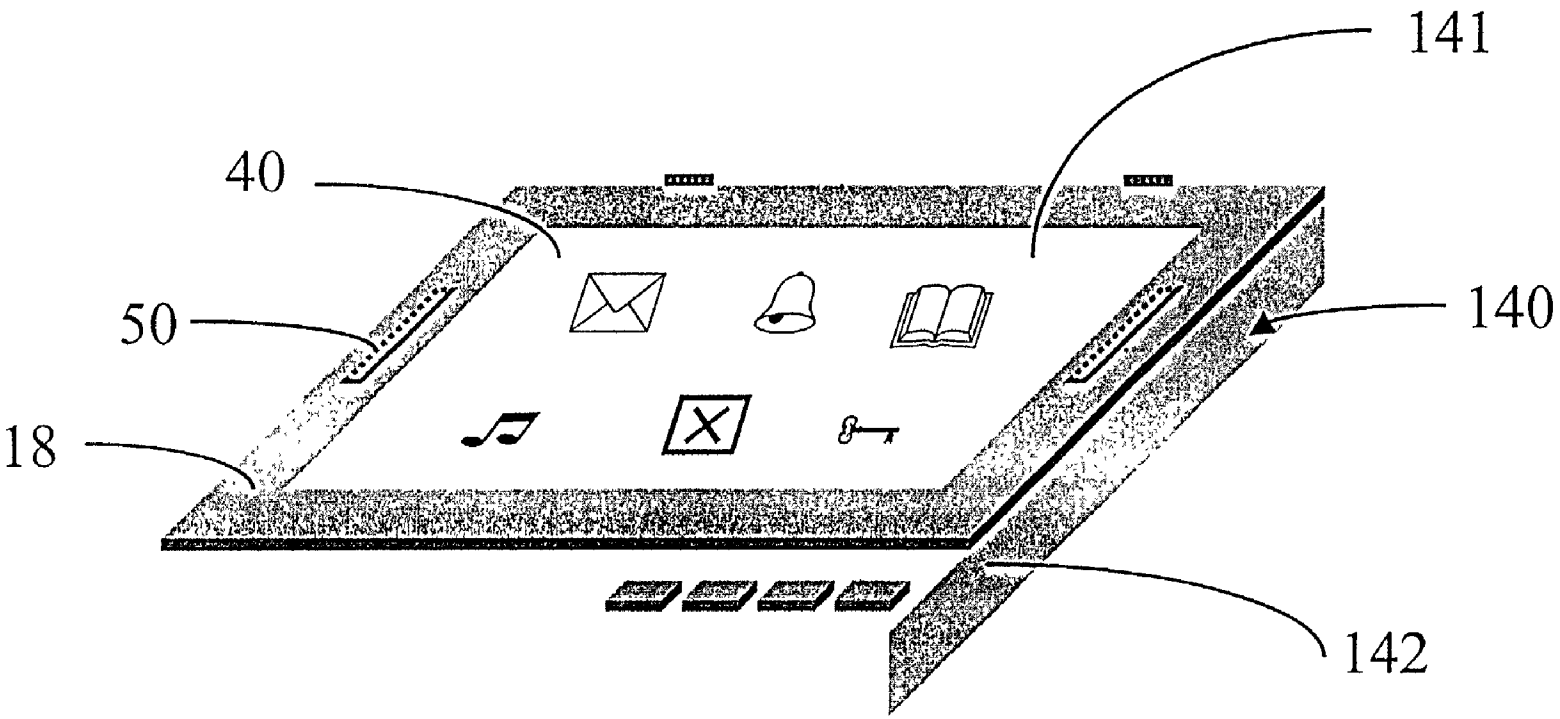
Figure 14B:
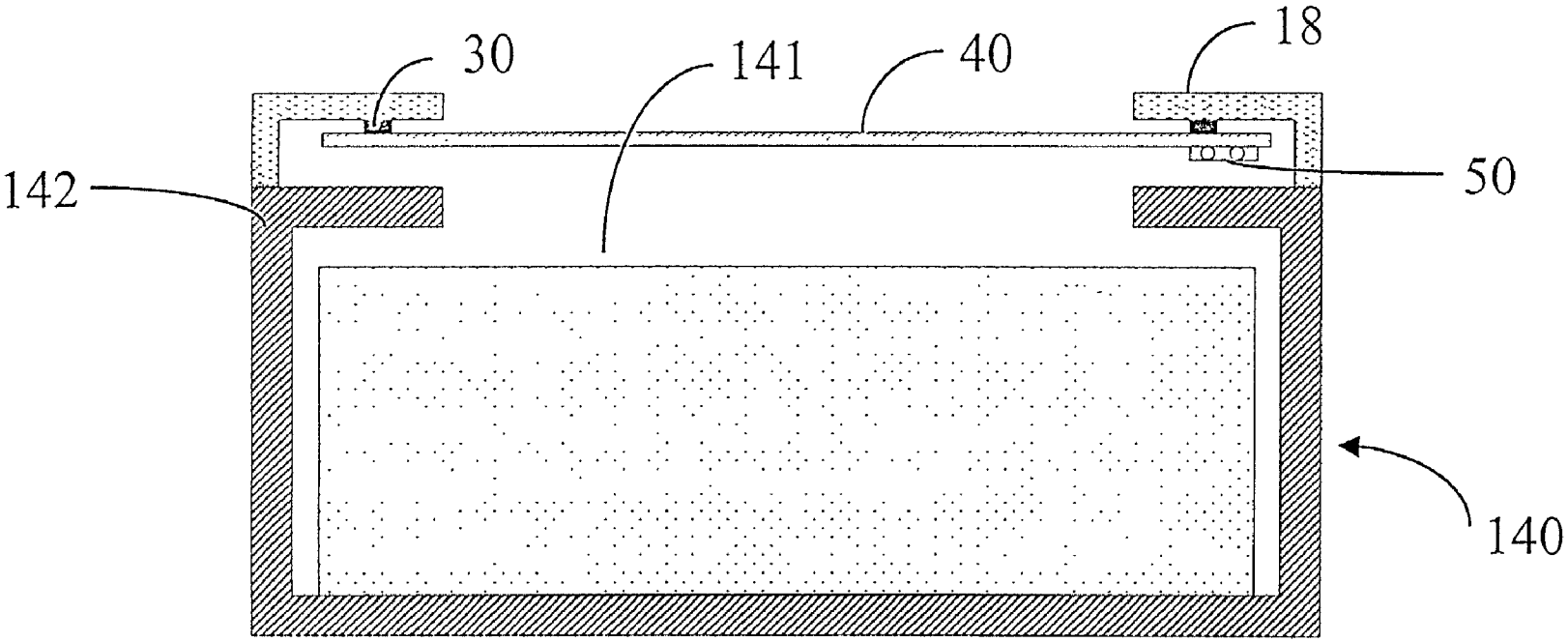
Figure 14C:
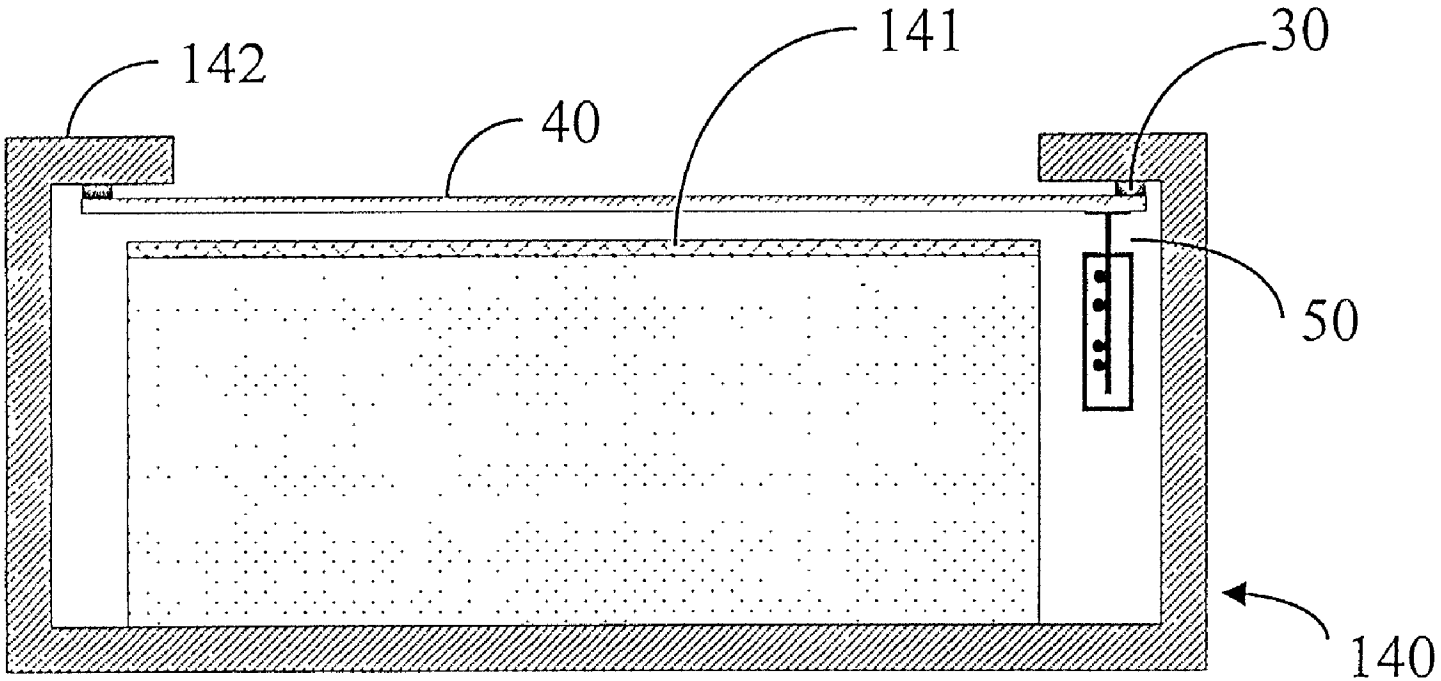

FIGS. 11*a*–11*c* are illustrations of a cellular phone equipped with a transparent panel-form loudspeaker;

FIG. 12 is an illustration of a video intercom equipped with a transparent panel-form loudspeaker;

FIGS. 13*a*–13*c* are illustrations of a video camera equipped with a transparent panel-form loudspeaker; and FIGS. 14*a*–14*c* are illustrations of a personal digital assistant (PDA) equipped with a transparent panel-form loudspeaker.

DETAILED DESCRIPTION OF THE PREFERRED EMBODIMENTS

The theoretical background of the proposed method is illustrated as follows.

The method for the design of the present transparent panel-form loudspeaker is established on the basis of the effective modal parameters identification method which utilizes both the analyses of modal vibration and sound pressure level spectrum in identifying the beneficial modal parameters of the transparent panel radiator for sound radiation. In the effective modal parameters identification method, a vibrating transparent panel is modeled as a surface sound source which displaces air volume at the interface. For an infinitely extended or baffled plate under flexural vibration, the sound pressure radiated from the plate can be evaluated using Rayleigh's first integral. The on-axis far-field sound pressure P is then calculated using the following approximate expression $$P = -\left(\frac{\rho\omega^2}{2\pi}\right)\int_s W_0(x, y)e^{j[\beta(x,y)-kr]}\frac{ds}{r} \tag{1}$$

where ρ is air density, ω is vibrational angular frequency, k is wave number, ds is a differential surface element of the panel, r is the distance from surface element to measurement point, $W_0(x, y)$ is the amplitude of displacement in the axial direction of the surface element at point (x, y) on the panel, β(x,y) is the phase of displacement in the axial direction of the surface element, $j=\sqrt{-1}$, and s is the surface area of the panel. In case the vibrating panel is an unbaffled plate of finite size, the sound pressure at any point can be evaluated using the finite element or boundary element methods. The sound pressure level at the measurement point is obtained from the equation $$L_P = 20\log_{10}\frac{P_{rms}}{P_{ref}} \tag{2}$$

where $L_P$ is sound pressure level, $P_{rms}$ is the root-mean-square value of sound pressure at the measurement point, and $P_{ref}$ is the reference pressure which is a constant. It is noted that the sound pressure level spectrum of the vibrating panel can be constructed via the use of Equations (1) and (2). In view of Equation (1), for given angular frequency and panel size the magnitude of sound pressure at a specific point depends only on the displacement amplitudes and phases of the surface elements. It is obvious that the sound pressure is directly proportional to the displacement amplitudes of the surface elements of the panel while the phases of the surface elements may have beneficial or adverse effects on the sound pressure. The phases of the surface elements depend on the deflected shape of the panel wherein the phase difference between the positive and negative displacements of the surface elements is 180°. Consequently, for surface elements of the panel oscillating in opposite phase, the sound pressures generated by the adjacent regions of opposite phase tend to short circuit each other. Therefore, it is important that proper displacement amplitudes and deflected shape should be generated for the panel if a specific sound pressure level is desired. The displacement amplitudes and phases of the surface elements can be determined in the modal analysis of the panel. The modal analysis of the panel, on the other hand, can be accomplished using the finite element method or any appropriate analytical method. Hence in the modal analysis, the deflection of a vibrating panel, W(x, y), which is approximated by the sum of a finite number of modal deflections can be expressed in the following form $$W(x, y, t) = \sum_{i=1}^{n} [A_i \Phi_i(x, y) \sin(\omega t - \theta_i)] \tag{3}$$

where $A_i$, $\Phi_i(x,y)$, $\theta_i$ are modal amplitudes, mode shapes and modal phase angles, respectively; n is number of modes. It is noted that the displacement magnitude and deflected shape of the panel are dependent of the modal parameters, $A_i$, $\Phi_i$ and $\theta_i$, which in turn depend on the mass, stiffness, damping and locations of excitation of the panel. As mentioned before, sound pressure level is dependent of the displacement magnitude and deflected shape of the panel, it is thus important to identify the modal parameters which are beneficial for sound radiation when designing a radiating panel. The theory of vibration has also revealed the facts that for a panel vibrating with a specific mode shape, resonance can significantly amplify the modal amplitude of the vibration mode, variation of excitation location can vary the modal amplitude of the mode, and the coincidence of the excitation location with one of the node lines of the mode suppresses the deflection of the mode. The amplification of modal amplitude at resonance together with the coincidence of the excitation location with the point where the maximum deflection of the mode shape occurs may drastically raise the sound pressure level at the resonant frequency and thus form a sharp peak in the sound pressure level spectrum. On the contrary, the coincidence of the excitation location with any one of the node lines of the mode under excitation when coupled with the small displacements contributed from other modes may drastically reduce the sound pressure level at the resonant frequency and thus form a valley in the sound pressure level spectrum. There are also other factors that may cause a drastic decrease in sound pressure level. For instance, as revealed in Equation (3), if the dominant vibration mode has an anti-symmetric mode shape, the sound waves emitting from regions of opposite vibration phase on the panel tend to short circuit each other and such interferences of sound waves of opposite phase may lead to an immense decrease in sound pressure level generated at this vibration frequency. All the aforementioned difficulties encountered in the design of a sound radiating panel, if improperly tackled, may lead to the production of unacceptable fluctuations in the sound pressure level spectrum over the audible frequency range for the panel. The modal parameters that can cause beneficial or adverse effects on sound radiation should be identified and then taken into account in the design of a radiating panel so that a more uniform distribution of sound pressure level over a specific frequency range can be obtained for the panel. In general, a properly designed radiating panel should have a suitable distribution of natural frequencies over the selected acoustic frequency range and avoid clustering of natural frequencies so that the modal parameters associated with the specific natural frequencies, which are in the vicinity of the excitation frequency and have direct effects on sound radiation at that excitation frequency, can provide suitable contributions to the sound pressure level at the excitation frequency. The specific natural frequencies are divided into two groups, i.e., the one that has beneficial effects on sound radiation and the other that has adverse effects on sound radiation. The contribution of the beneficial group of natural frequencies to sound pressure level can be increased by maximizing the modal amplitudes associated with those natural frequencies while the contribution of the adverse group of natural frequencies can be reduced or alleviated by minimizing the modal amplitudes or altering the mode shapes and phases associated with those natural frequencies.

As mentioned before, modal parameters are dependent of the mass, stiffness, damping and locations of excitation of a panel. Regarding the panel stiffness, it is affected by the elastic modulus of the constituted material, the dimensions of the panel, and the support conditions around the peripheral edge of the panel. In the present invention, one part of a flexible suspension device is used to support the panel at several specific points on the peripheral edge of the panel. Altering the locations of the discrete supporting points and/or the stiffness of the suspension device can vary the stiffness and thus the modal parameters of the panel. Damping has direct effects on the modal amplitudes and phases. In general, panels with damping less than 10% are suitable to be used as sound radiators. For a free rectangular panel of given length a and width b, the effects of the panel mass and stiffness on the sound radiation efficiency of the panel are dependent of the ratios of elastic modulus E to density ρ and length, a, to thickness, h. In view of the above investigation, it is obvious that the design of an edge constrained transparent radiating panel involves the selection of the appropriate values for the basic design variables which are the elastic modulus to density ratio $$\frac{E}{\rho},$$

length to thickness ratio $$\frac{a}{h},$$

and locations of the excitation and supporting points on the peripheral edge of the radiating panel.

In recent years, optimization methods have been extensively used in the design of engineering products. Since the use of an appropriate optimization method can produce the best design for an engineering product in an efficient and effective way, it is thus advantageous to use an optimization method in the design of the present transparent panel-form sound radiator. Herein, a two-level optimization technique is adopted to design a rectangular radiating panel with given area (a×b). In the first level optimization, the optimal values of the ratios of elastic modulus to density and length to thickness are determined to maximize the sound pressure levels of some specific acoustic frequencies for the panel with given locations of excitation and supporting points. A transparent panel with given thickness made of specific material is then selected to complete this level of optimization. In the second level optimization, the locations of excitation and supporting points for the chosen transparent panel are determined to make the distribution of sound pressure level more uniform in a specific frequency range. In mathematical form, the problem of the second level optimization is stated as $$\text{Minimize } e = \sum_{i=1}^{m} (L_{p_i} - \overline{L}_p)^2 \tag{4}$$

where $L_{Pl}$ is the sound pressure level at frequency $\omega_l$; m is number of frequencies under consideration; $\overline{L}_P$ is the average of the m sound pressure levels; e is error function measuring the sum of the differences between the sound pressure levels and their average. The objective of this level of optimization is to minimize the error function for obtaining a more uniform distribution of sound pressure level spectrum over a specific acoustic frequency range. The above two levels of optimization can be accomplished using, for instance, the genetic algorithm or any stochastic global optimization technique.

From the detailed optimal design of the transparent radiating panel, it is concluded that if the radiating panel is required to generate satisfactory sound pressure level within the frequency range from 50 Hz to 20 KHz, the ratios of elastic modulus to density and length to thickness must satisfy, respectively, the following conditions:

$$3 < \frac{E}{\rho} < 180\left(\frac{G\rho a}{g/\text{cm}^3}\right) \text{ and} \tag{5}$$

$$80 < \frac{a}{h} < 600 \tag{6}$$

Furthermore, the location of any transducer must be at least one tenth of the length of the edge on which the transducer is mounted away from the two ends of the edge and the number of discrete supporting points on each edge of the panel does not exceed ten.

Preferred embodiments of the present invention will be described hereunder with reference to the accompanying drawings.

Figure 1A:
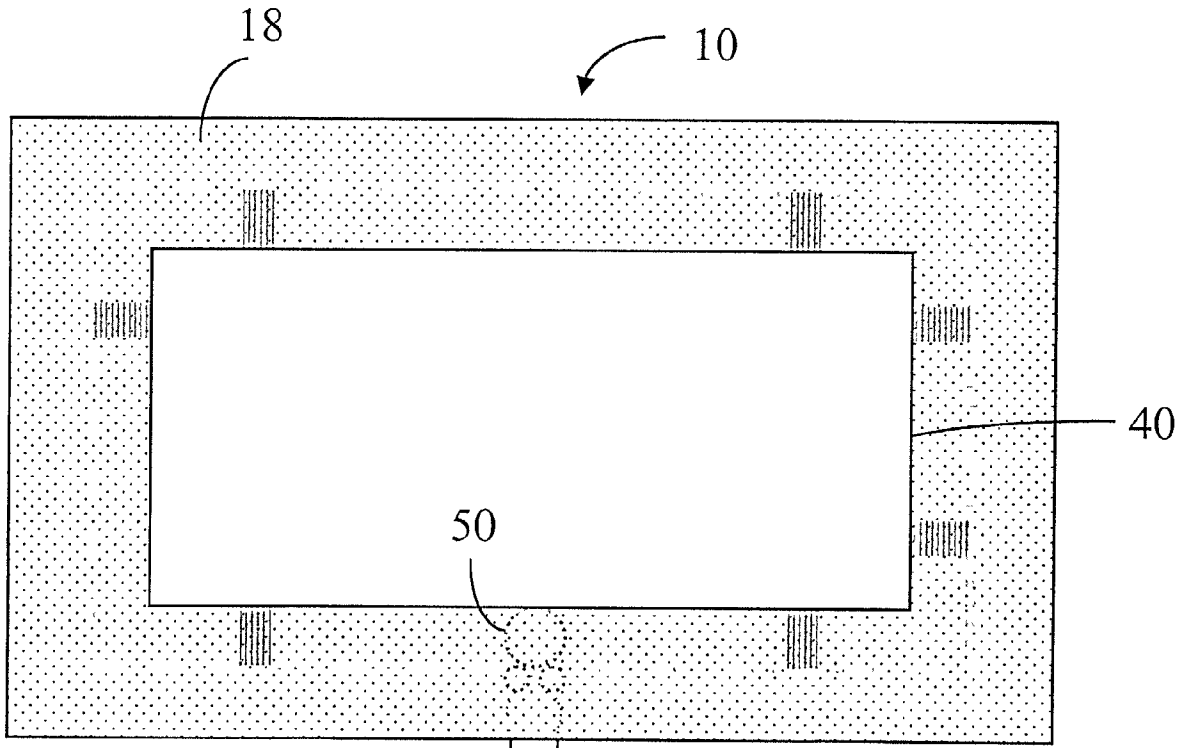
Figure 1B:
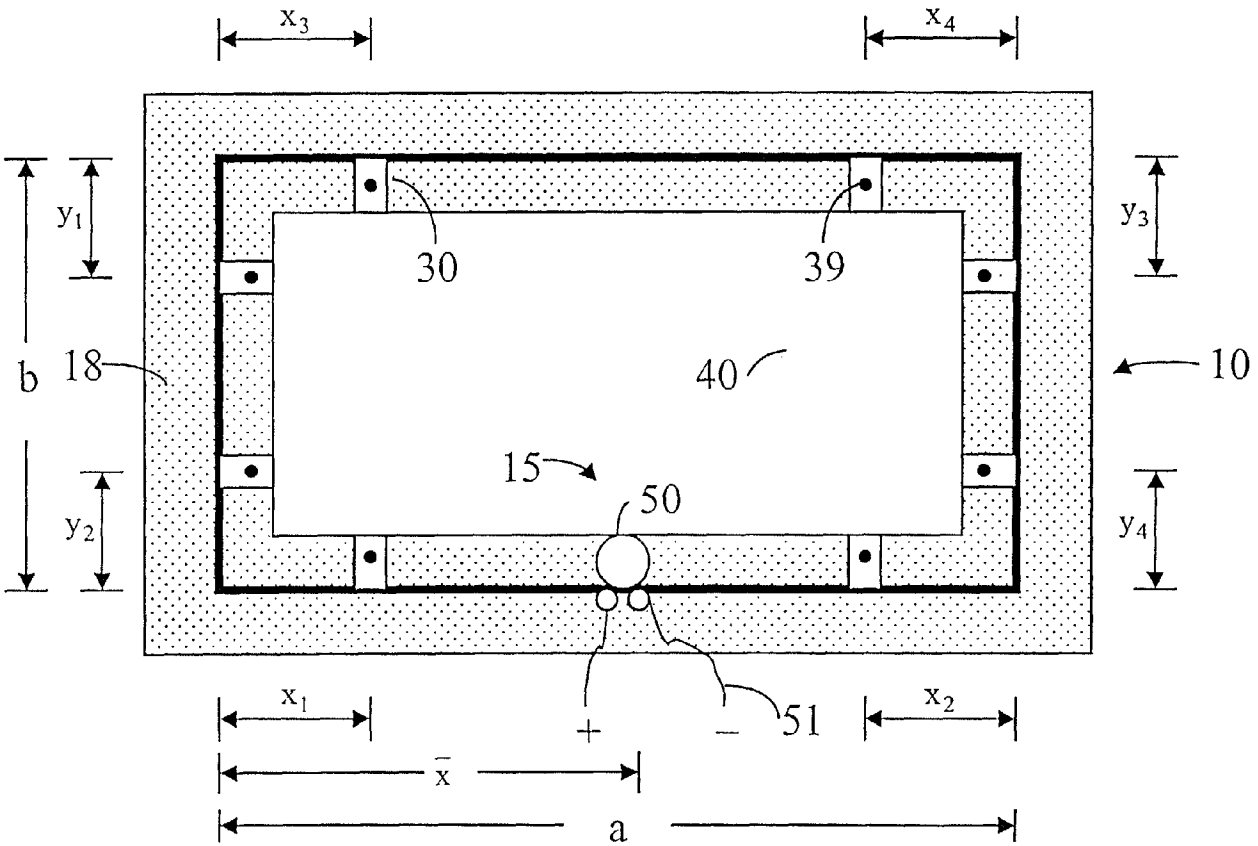

Referring to FIG. 1 of the drawings, a transparent panel-form loudspeaker (10) consists of a rectangular transparent panel-form sound radiator (15), a flexible suspension device (30) used to sustain the peripheral edge of the panel-form sound radiator, and a rigid frame (18) used to support the suspension device. On the other hand, the sound radiator (15) consists of a transparent panel (40) and at least one transducer (50). The length, width, and thickness of the transparent panel are defined as a, b and h, respectively, and b is less than or equal to a. The transparent panel is made of a kind of transparent materials such as glass, polystyrene (PS), polyvinyl chloride (PVC), polymethyl methacrylate (PMMA), polyethylene terephthalate (PET), polycarbonates (PC) and etc. The ratios of elastic modulus to density and length to thickness for the transparent panel are selected to be in the ranges from 3 to 180 GPa/(g/cm$^3$) and 80 to 600, respectively. The flexible suspension device consists of two parts, ie, a continuous plastic-impregnated corrugated cloth (30*c*) used to support the whole periphery of the transparent panel and several discrete foam plastic pads (30*a*) or tension wires (30*b*) used to support the peripheral edge of the transparent panel at some specific supporting points (39). The locations of the specific supporting points (39) on the long and short edges of the panel are denoted as $x_l$ and $y_l$, respectively. In general, the number of the supporting points on each edge of the transparent panel is less than ten. The transducer (50) mounted on the peripheral edge of the transparent panel is used to induce flexural vibration of the panel for sound radiation. The location of the transducer mounted on the long or short edges is denoted, respectively, as x or y under the conditions that $$\frac{a}{10} < x < \frac{9a}{10} \text{ or } \frac{b}{10} < y < \frac{9b}{10}.$$

The positions of the transducer and supporting points on the peripheral edge of the transparent panel are selected according to the effective modal parameters identification method proposed by the present invention. The distance between the transducer and any supporting point should be greater than one tenth of the length of the edge on which the transducer is mounted. The transducer is also connected to an amplifier through two electric wires (51). The manipulation of the amplifier can adjust the driving force of the transducer and thus control the intensity level of the sound radiated from the panel-form loudspeaker (10).

Figure 2:
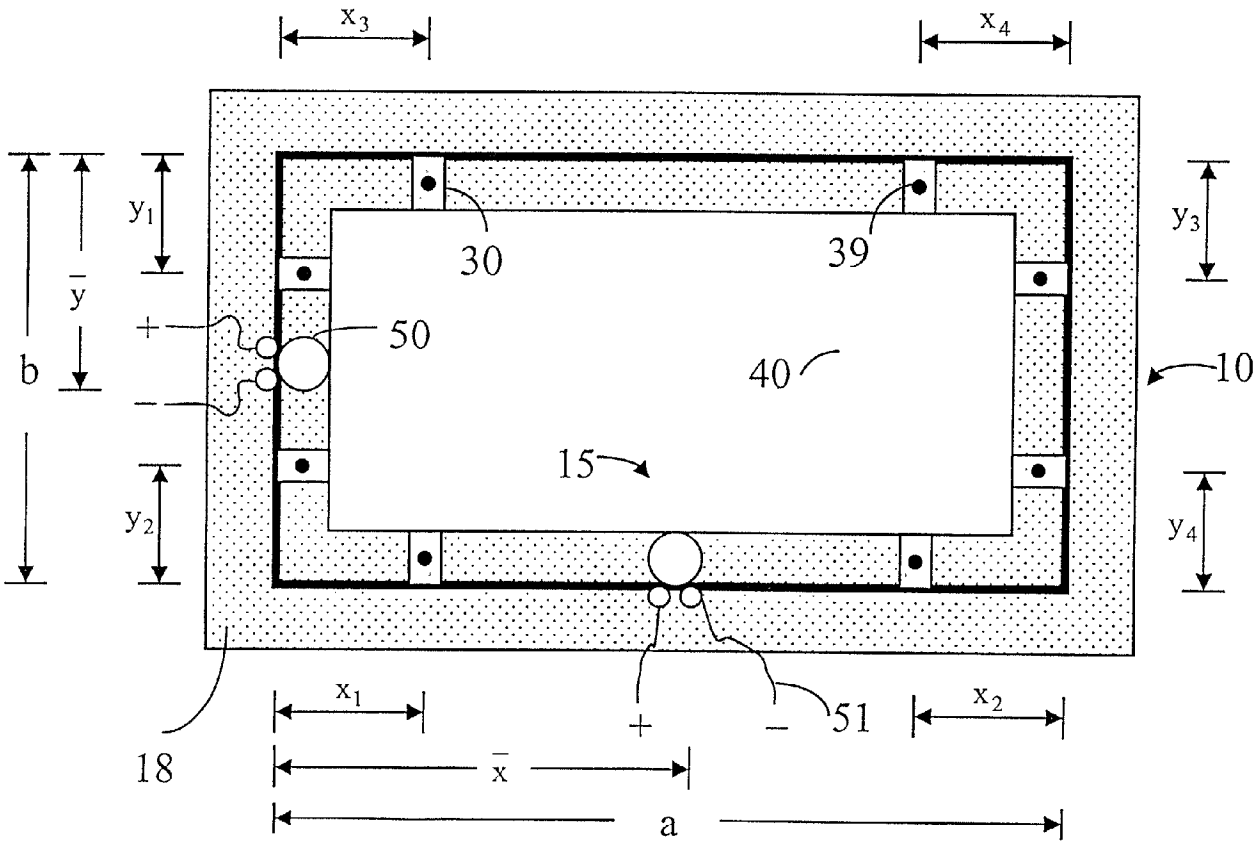

FIG. 2 is an illustration of a transparent panel-form loudspeaker utilizing two transducers (50) to induce flexural vibration of the transparent panel (40) for sound radiation. It is noted that besides the locations shown in FIG. 2, the two transducers, in fact, can be mounted on any two of the four edges of the transparent panel under the conditions that $$\frac{a}{10} < x < \frac{9a}{10} \text{ or } \frac{b}{10} < y < \frac{9b}{10}.$$

The positions of the two transducers on the peripheral edge of the panel are selected using the effective modal parameters identification method presented in this invention. It is also possible for the panel to have more than two transducers mounted on its peripheral edge. The locations of the transducers are again determined using the effective modal parameters identification method.

Figure 3A:
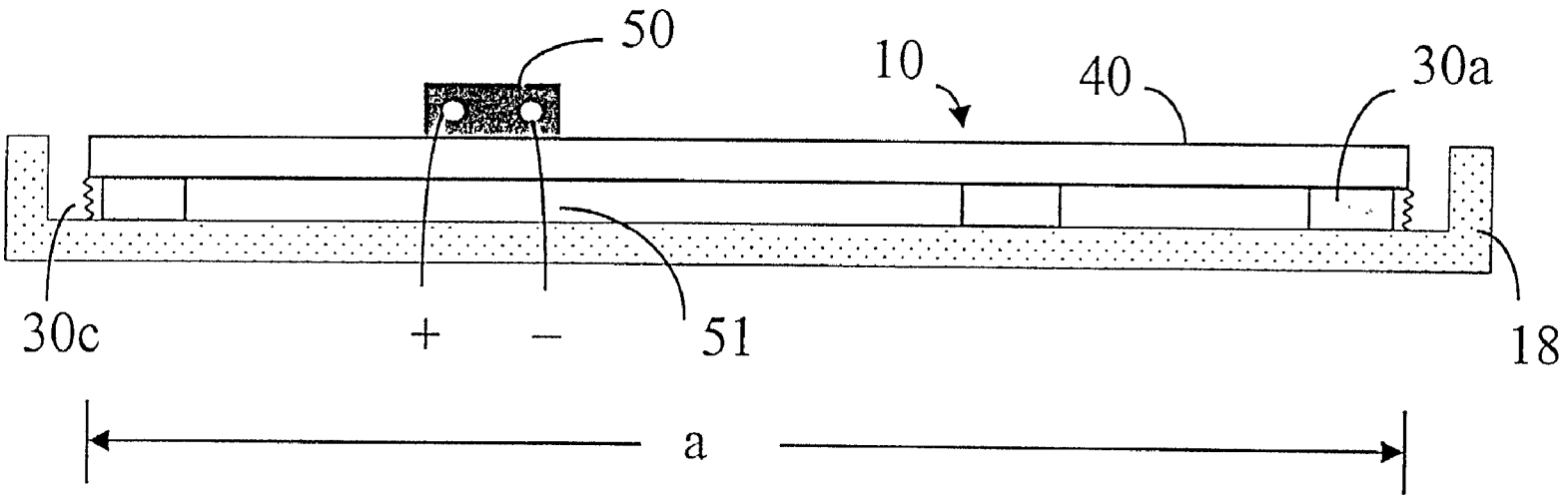
Figure 3B:
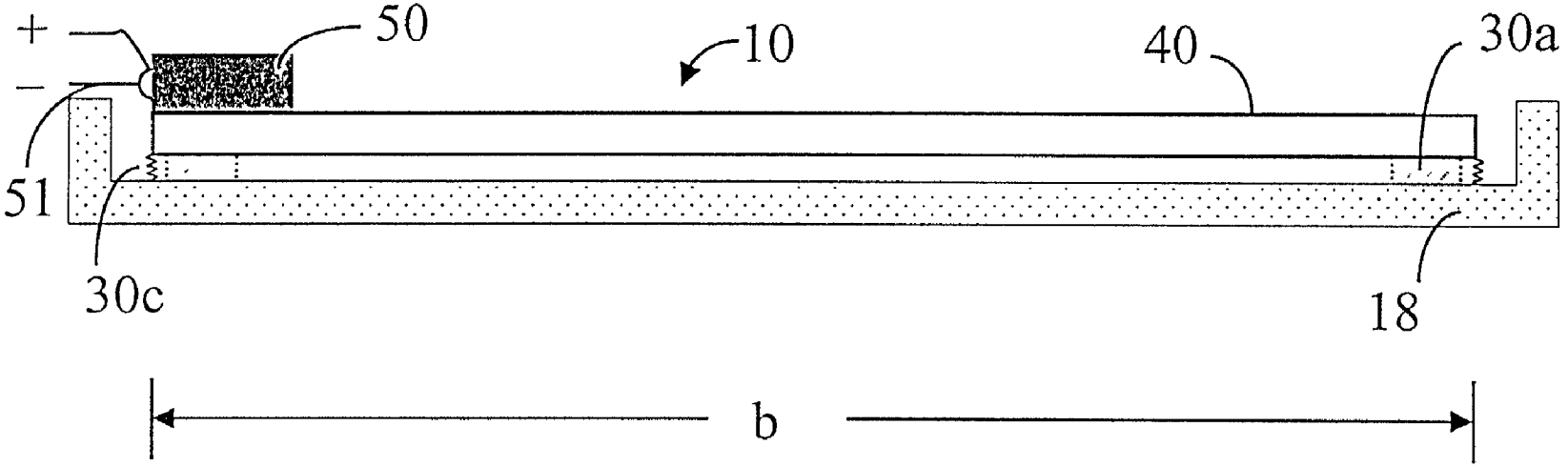

FIG. 3*a* and 3*b* are the typical sections of the panel-form loudspeaker (10) of FIG. 1 showing the transparent panel (40) supported by a flexible suspension device (30) consisting of several foam plastic pads (30*a*) and a continuous corrugated cloth type support (30*c*). The foam plastic pads which are mounted on the rigid frame (18) support the peripheral edge of the panel at some specific supporting points (39). The plastic pads are used to tune the vibration behavior of the transparent panel so that beneficial modal parameters can be generated. The locations of the supporting points are selected using the effective modal parameters method presented in this invention. The continuous corrugated cloth type support (30*c*) supporting around the peripheral edge of the transparent panel (40) is used to damp out the standing waves of short wavelengths at the peripheral edge of the panel.

Figure 4:
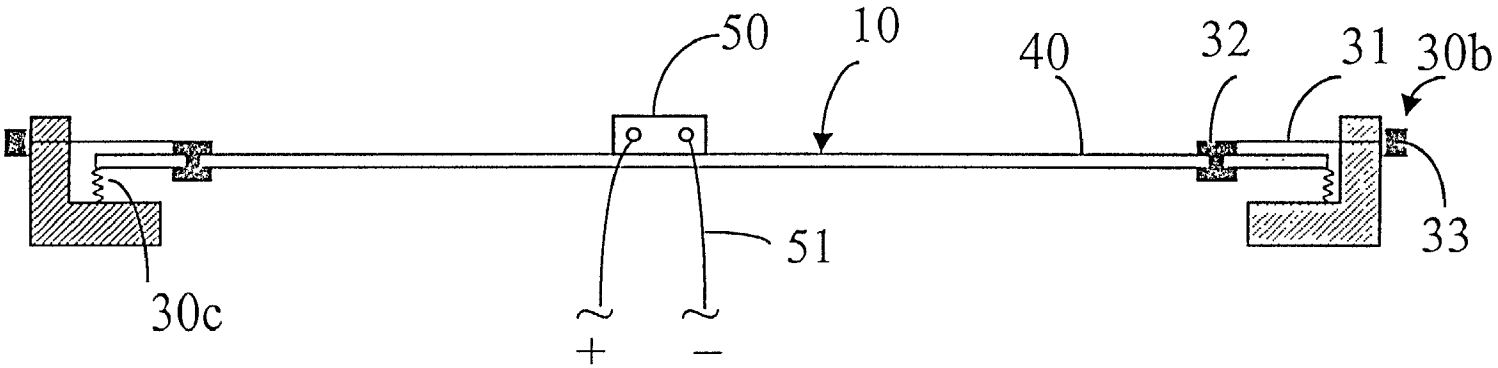

FIG. 4 shows the transparent panel (40) supported by a flexible suspension device consisting of several wires (30*b*) and a continuous corrugated cloth type support (30*c*). The wires which sustain the edge of the transparent panel at some specific supporting points can be used to tune the vibration behavior of the transparent panel for generating beneficial modal parameters. The locations of the specific supporting points are selected using the effective modal parameters method presented in this invention. The two ends of each wire are connected, respectively, to a pin (32) fixed at the peripheral edge of the transparent panel and a knob (33) mounted on the frame. The tensions in the wires, which have effects on the stiffness of the transparent panel, can be adjusted by turning the knobs. Proper selections of the locations of the supporting points and tensions in the wires can thus make the transparent panel possess appropriate modal parameters and produce the desired sound pressure level spectrum over a specific frequency range.

Figure 5A:
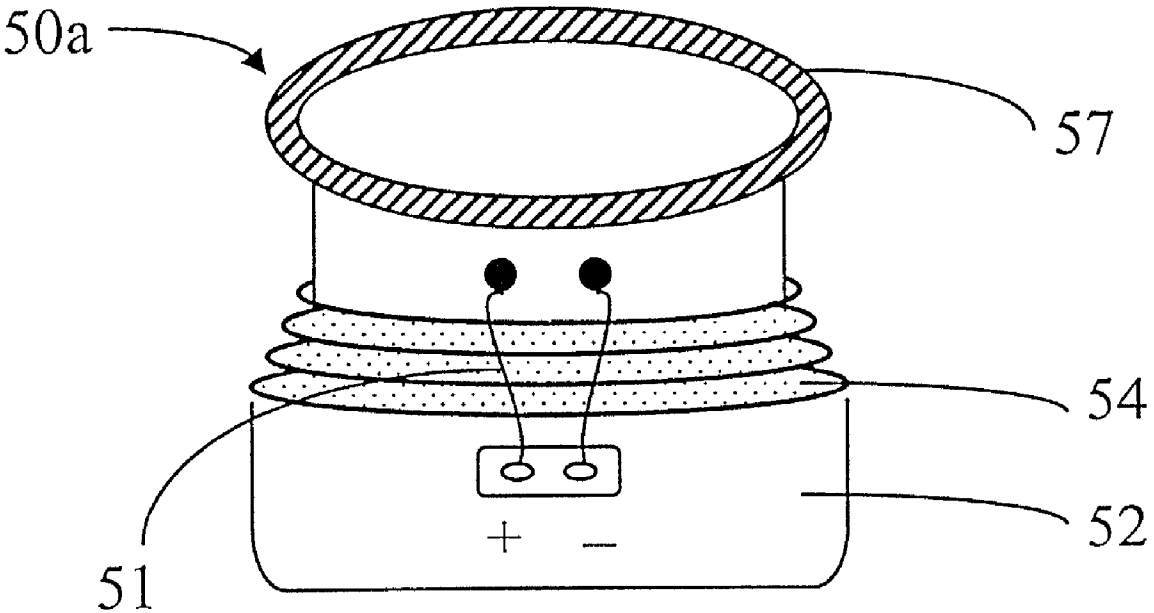
Figure 5B:
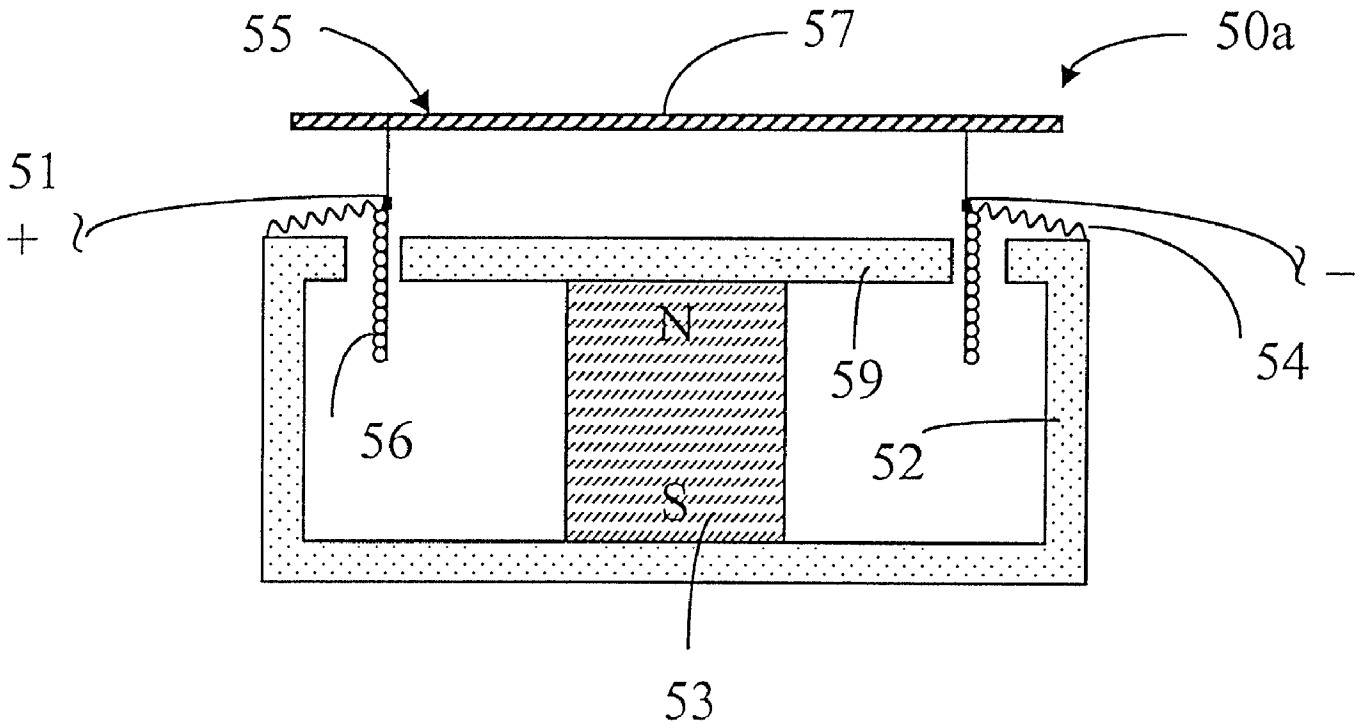

FIG. 5*a* is an illustration of a round-shaped electrodynamic type transducer (50*a*) used to excite the transparent panel (40) for sound radiation. FIG. 5*b* is a typical section of the round-shape electrodynamic type transducer. The transducer consists of a round permanent magnet (53), a round washer (52), a cylindrical voice coil unit (55) which is composed of a cylindrical moving coil (56) and a plastic ring (57), a flexible suspension (54) and a round top plate (59). A magnetic field is formed at the gap between the peripheral edges of the washer (52) and the round top plate (59). The moving coil which is supported by the flexible suspension is immersed in the magnetic field at the gap between the peripheral edges of the washer and the top plate. The plastic ring (57) attached to the top of the moving coil is used to bind the transducer adhesively to the surface of the transparent panel. When electric current flows through the moving coil, the voice coil unit will drive the transparent panel to vibrate flexurally and radiate sound.

Figure 6A:
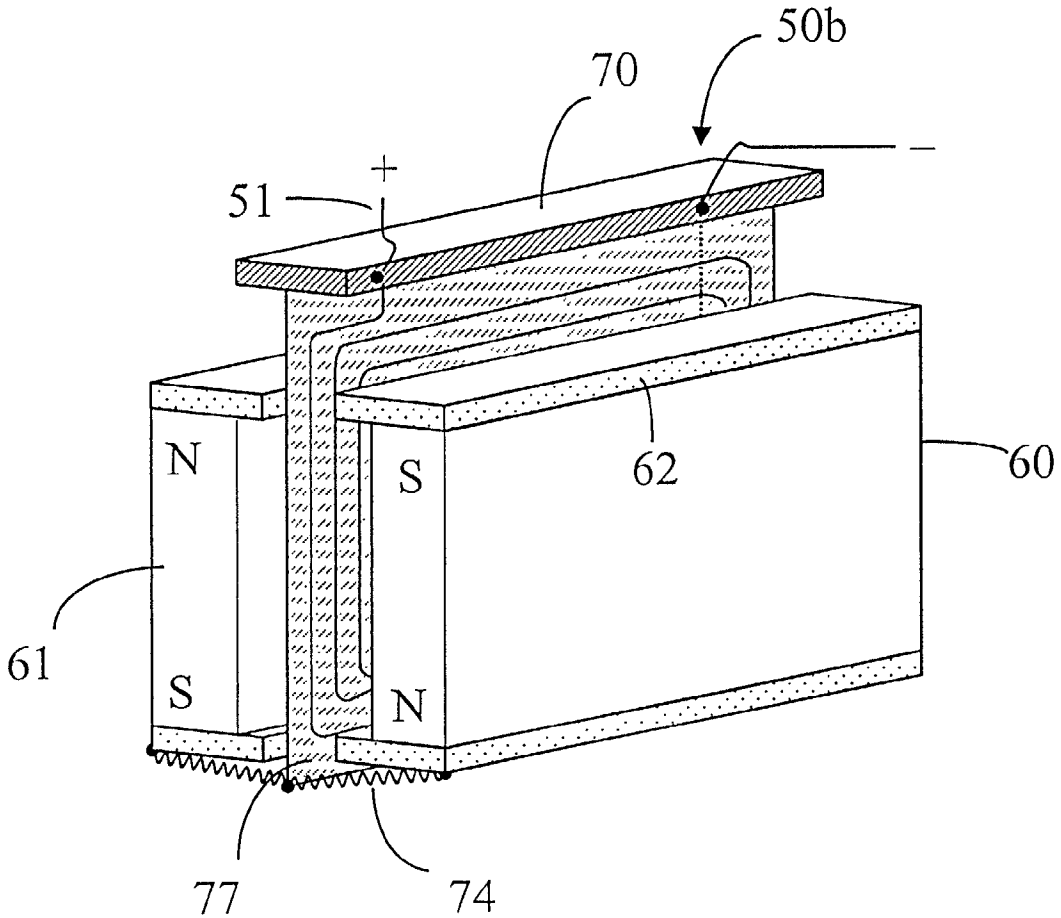
Figure 6B:
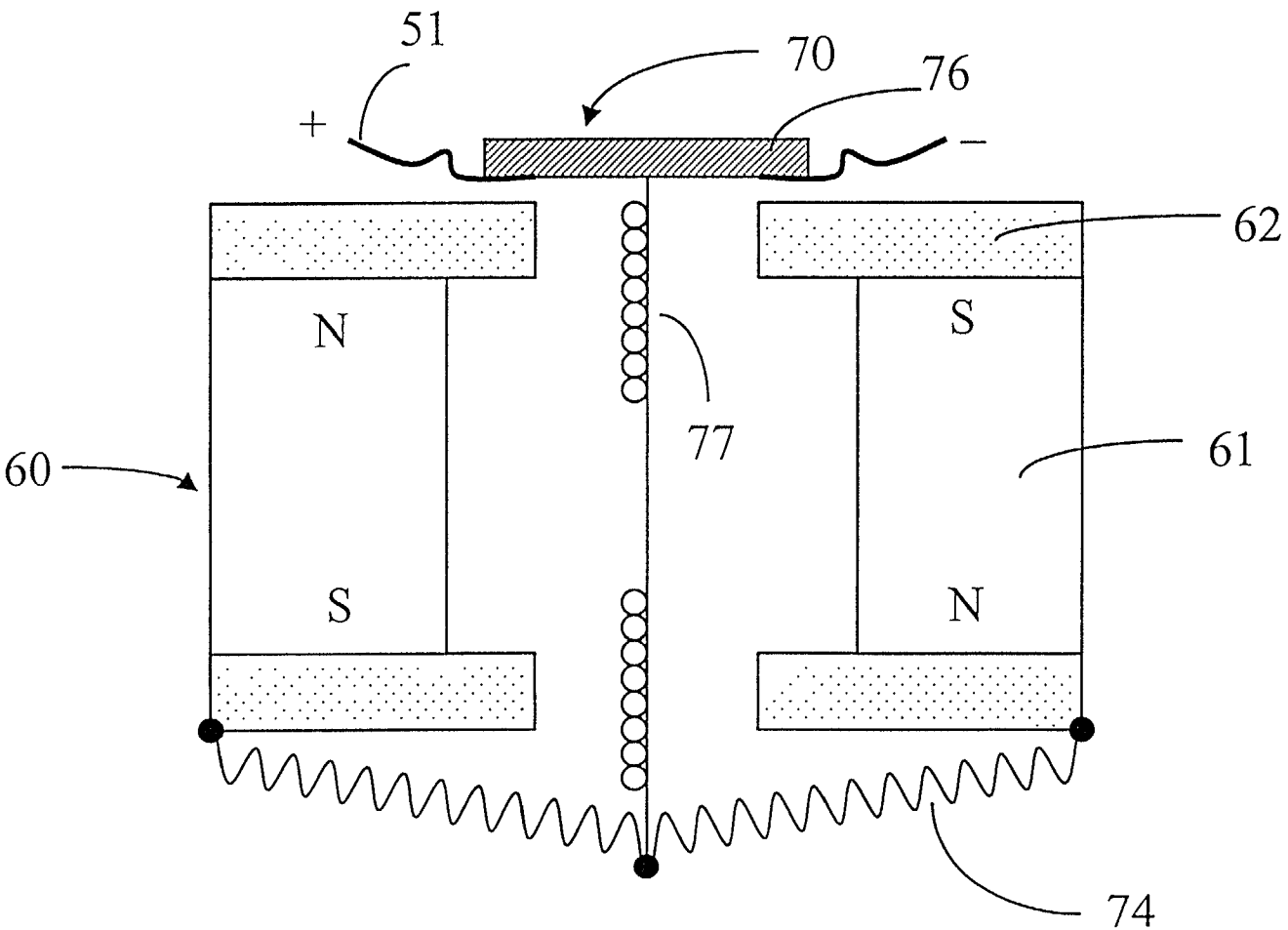
Figure 6C:
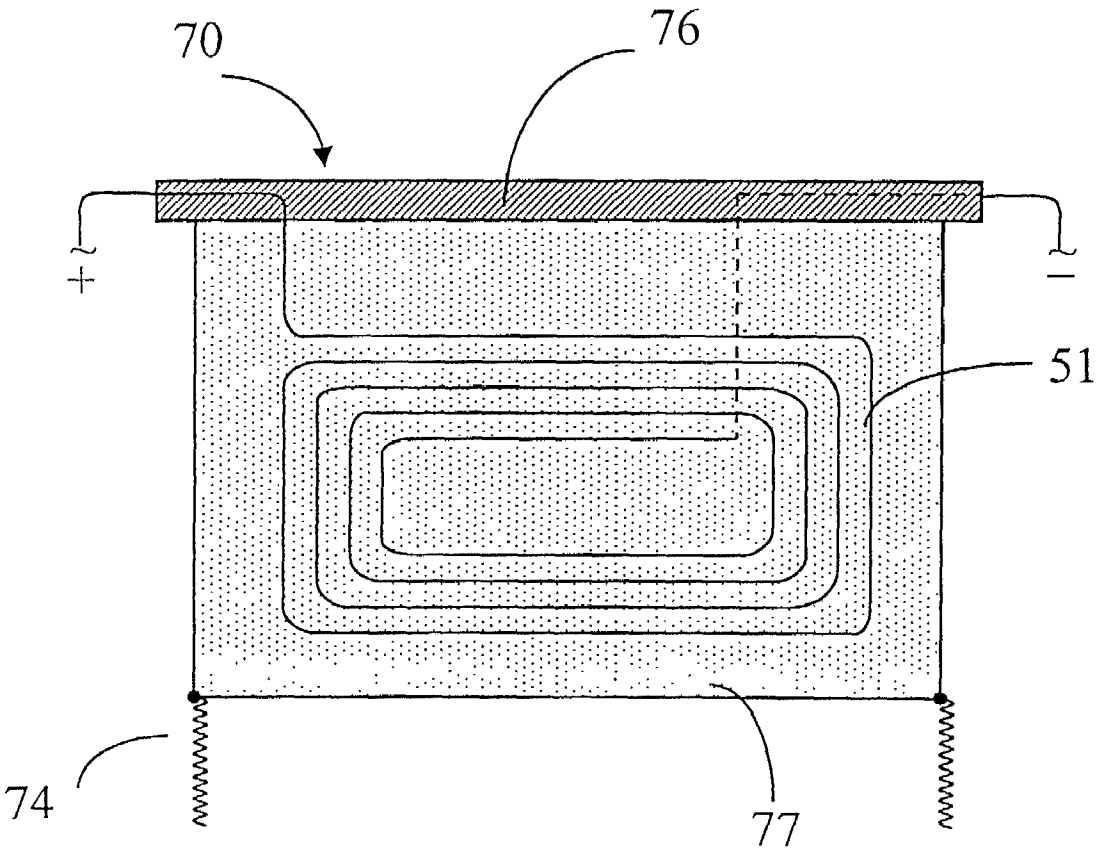

FIG. 6*a* shows a blade-like electrodynamic type transducer (50*b*) which can drive the transparent panel to vibrate flexurally and radiate sound. The blade-like transducer consists of a pair of magnetic units (60) in which each unit is made of a permanent magnet (61) and two face pole plates (62), a voice coil unit (70), and a flexible suspension (74). The voice coil unit, on the other hand, consists of a flat moving coil (77) and a top plastic strip (76). FIG. 6*b* is a typical section of the blade-like transducer (50*b*) showing that the flexible suspension (74) at the bottom of the voice coil unit is used to position the moving coil (77) in-between the two magnetic units (60) which have opposite magnetic poles facing to each other for the top as well as the bottom face pole plates of the magnetic units. When electric current passes through the moving coil, the voice coil unit will generate a vertical motion. FIG. 6*c* is an illustration of the voice coil unit together with the flexible suspension. The mounting of the voice coil unit on the transparent panel is accomplished by adhesively binding the top thin strip (76) to the surface of the transparent panel. The circulation of electric current in the flat rectangular moving coil is clockwise and thus the flows of the electric current in the upper and lower sides of the rectangular moving coil are in opposite direction. When placed in-between the two magnetic units, the upper and lower sides of the flat moving coil are immersed, respectively, in the upper and lower magnetic fields formed by the face pole plates of the two magnetic units. Since the magnetic fluxes in the upper and lower magnetic fields are in opposite direction, the upper and lower sides of the flat moving coil will produce vertical forces acting in the same direction. The flexible suspension is made of several springs tied to the bottom corners of the voice coil unit. When the voice coil unit is in motion, the springs can be used to make the voice coil unit to remain vertical at the center of the gap between the two magnetic units.

Figure 7:
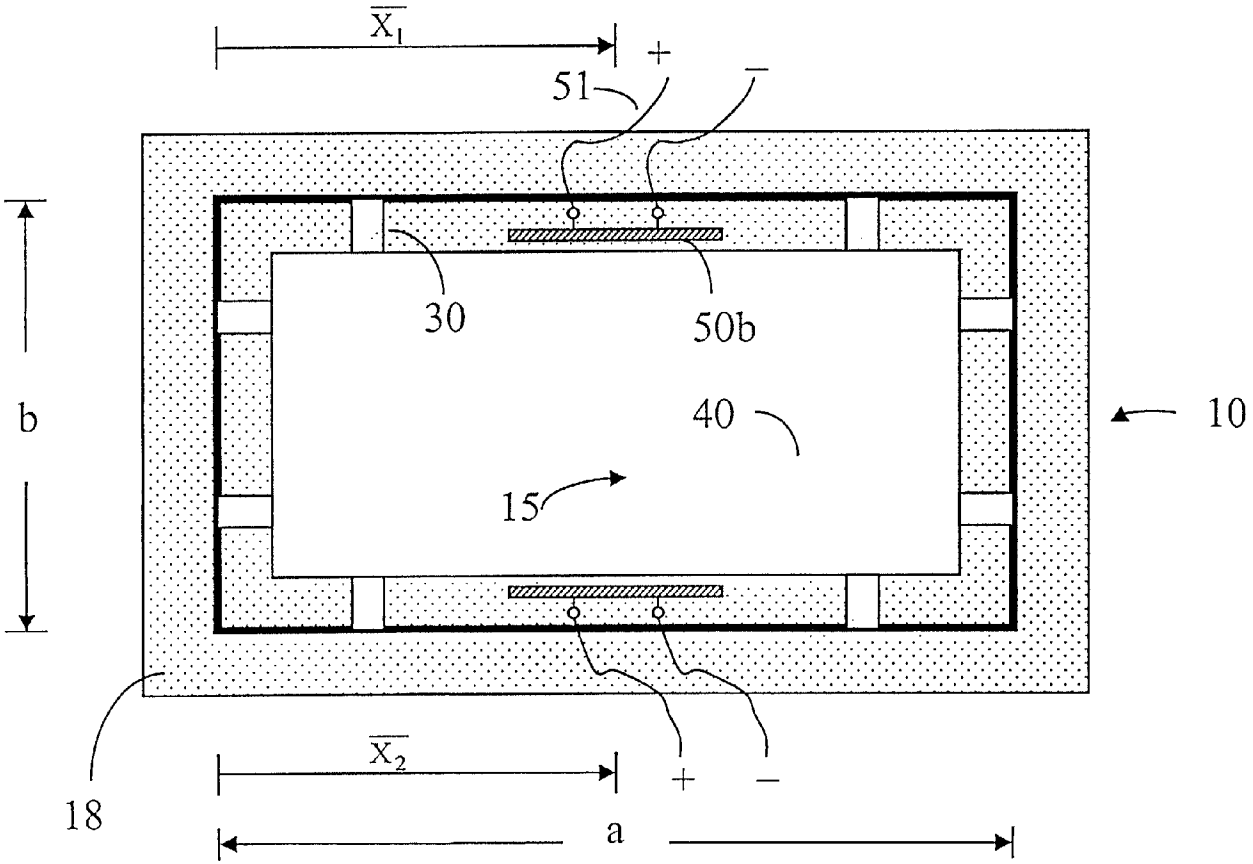
FIG. 7 is an illustration of a transparent panel-form loudspeaker with two blade-like electrodynamic transducers mounted on the peripheral edge of the panel radiator.

FIG. 7 is an illustration of a transparent panel-form loudspeaker (10) using two blade-like electrodynamic transducers (50*b*) to drive the transparent panel (40) for sound radiation. The locations of the blade-like transducers on the peripheral edge of the transparent panel are denoted by $\bar{x}_i$ with i=1 or 2. Under the condition that $$\frac{1}{10}a < \bar{x}_i < \frac{9}{10}a,$$

the appropriate locations of the transducers can be determined using the effective modal parameters identification method presented in this invention. The same procedure can also be applied to deal with the cases in which three or more transducers are used to drive the transparent panel.

Figure 8:
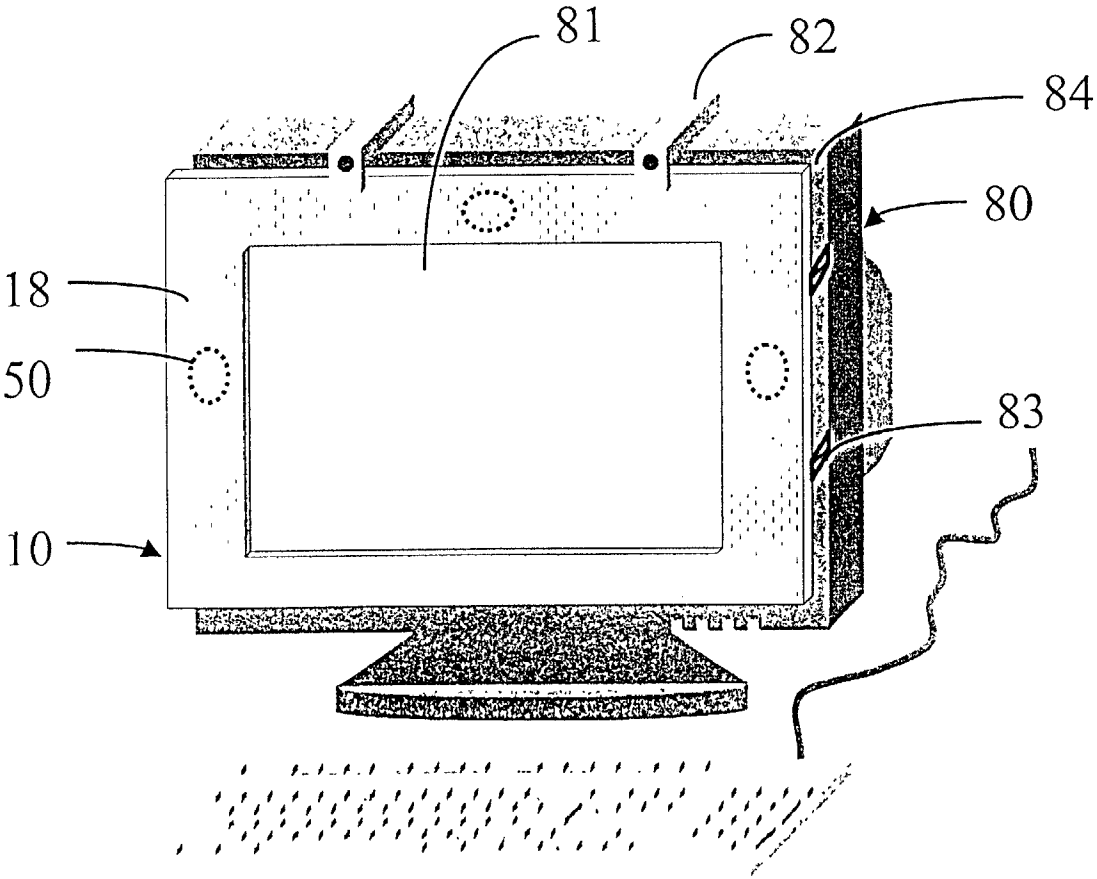
FIG. 8 is an illustration of a CRT monitor equipped with a transparent panel-form loudspeaker.

FIG. 8 shows a CRT monitor (80) equipped with a transparent panel-form loudspeaker (10). The transparent panel-form loudspeaker is hung in front of the screen (81) of the CRT monitor using several channel-shaped hooks (82). Several adhesive foam-plastic pads (83) are placed in-between the frame (18) of the transparent panel-form loudspeaker and that of the CRT monitor (84) to position the loudspeaker and damp out the vibration generated by the loudspeaker.

Figure 9:
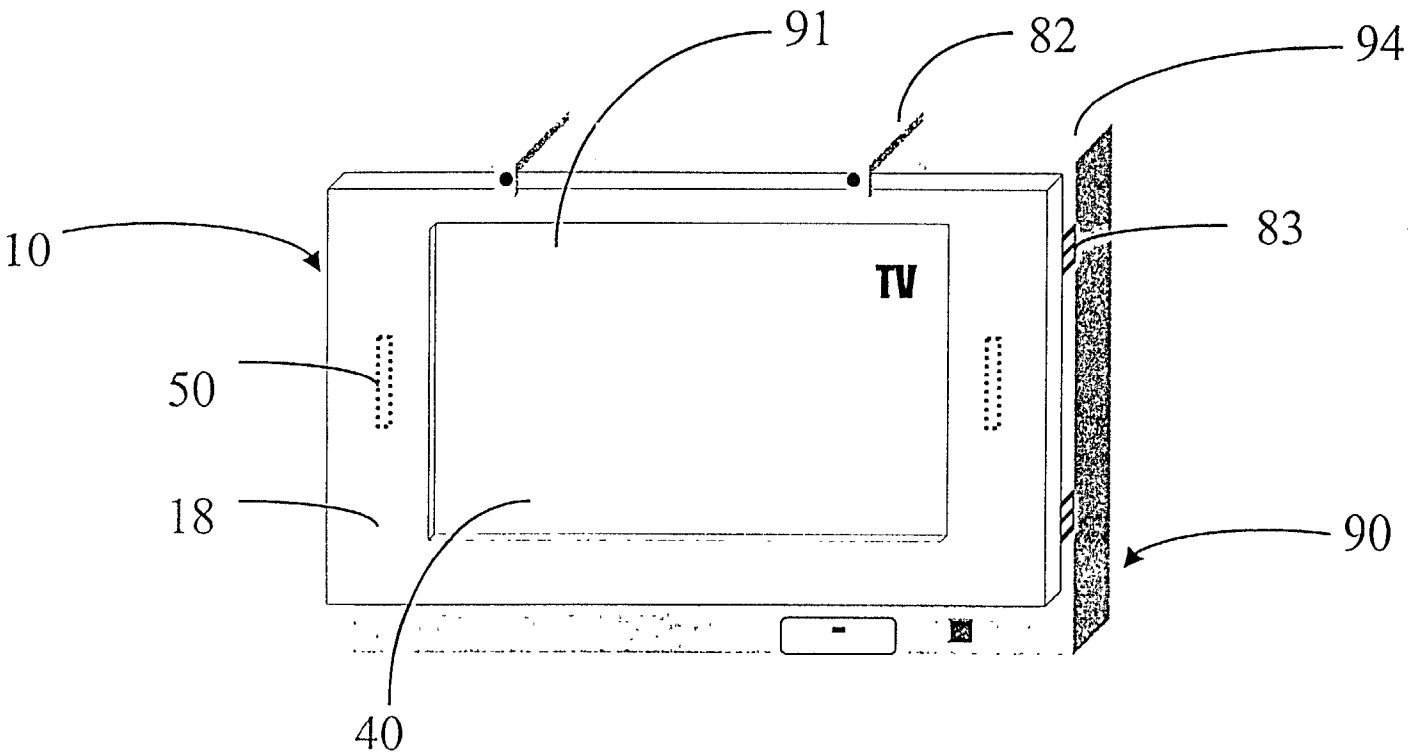
FIG. 9 is an illustration of a television set equipped with a transparent panel-form loudspeaker.

FIG. 9 shows a transparent panel-form loudspeaker (10) hung in front of the screen (91) of a television set (90) via the use of several channel-shaped hooks (82). Several adhesive foam-plastic pads are placed in-between the frame (18) of the transparent panel-form loudspeaker and that of the television set (94) to position the loudspeaker and damp out the vibration generated by the loudspeaker.

Figure 10:
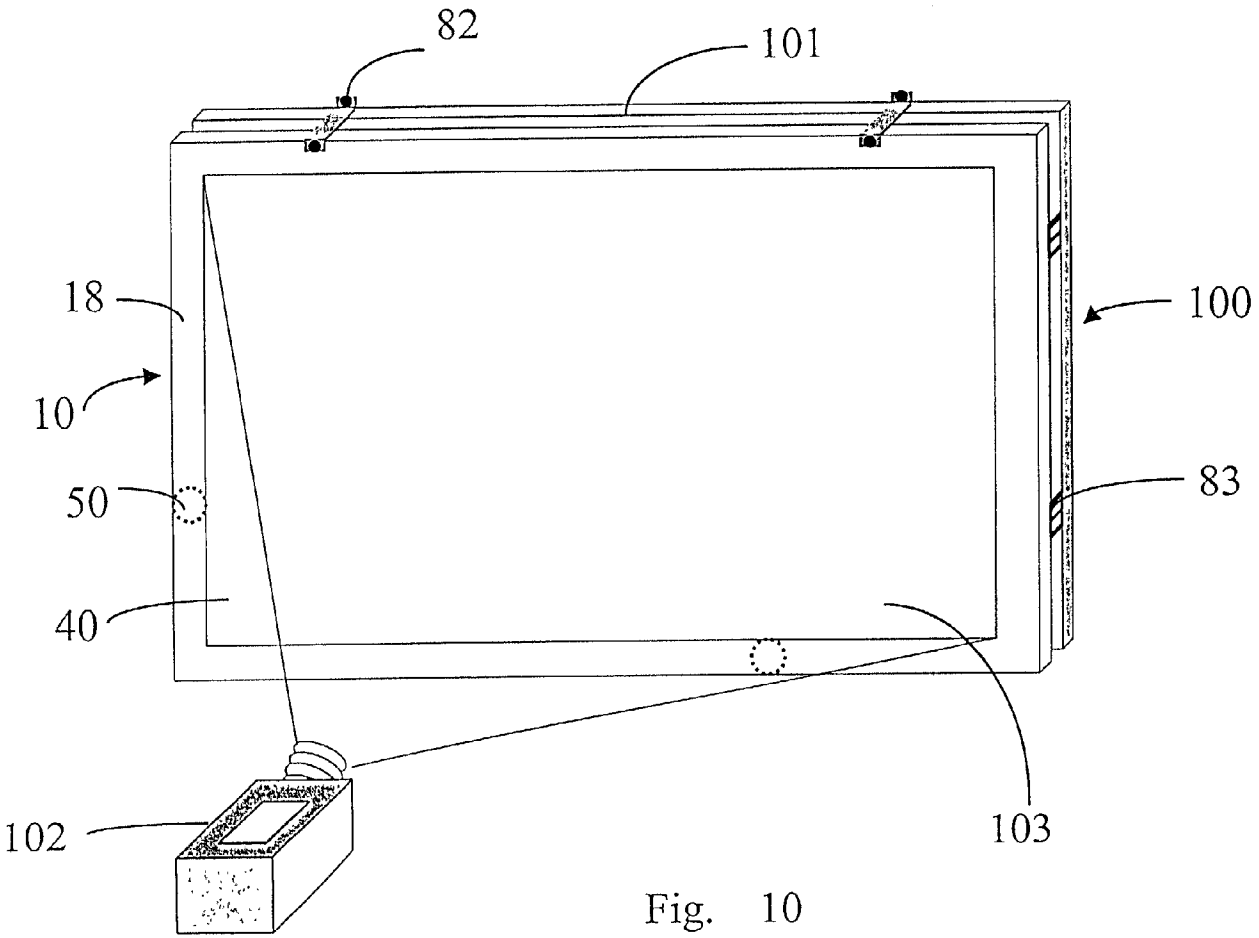
FIG. 10 is an illustration of a projection screen equipped with a transparent panel-form loudspeaker.

FIG. 10 shows a transparent panel-form loudspeaker (10) hung in front of a projection screen (100) via the use of several hooks mounted on the top horizontal shaft (101) of the projection screen (100). The pictures emitted from the video player (102) will go through the transparent panel-form loudspeaker and then be projected on the screen (103) unobstructively while sound is radiated from the transparent panel-form loudspeaker in a synchronous manner.

FIG. 11*a* shows a transparent panel-form loudspeaker (10) installed in front of the LCD screen (111) of a cellular phone (110). The incoming sound signals can be recovered and magnified via the transparent panel-form loudspeaker while the outgoing sound waves are collected and transmitted via a receiver (96). Among others, two cases are given to illustrate how the transparent panel-form loudspeaker is mounted on the cellular phone. FIG. 11*b* shows the first case of installing the transparent panel-form loudspeaker in front of the LCD screen. In this case, the frame of the panel-form loudspeaker is adhesively attached to the outer surface of the frame (112) of the LCD screen. FIG. 11*c* shows another installation case in which the flexible suspension device (30) of the transparent panel-form radiator (15) is mounted on the inner surface of the frame (112) of the LCD screen.

FIG. 12 shows a video intercom (120) equipped with a transparent panel-form loudspeaker (10) which is hung in front of the screen (121) of the intercom via several hooks (82). Several flexible foam-plastic pads are placed in-between the frame (18) of the panel-form loudspeaker and the frame (122) of the screen to position the panel-form loudspeaker and damp out the vibration generated by the loudspeaker. The user can communicate with other people via the panel-form loudspeaker (10) and the receiver (123) and, if necessary, open the gate by pressing the control button (124).

FIG. 13*a* shows a video camera or camcorder (130) equipped with a transparent panel-form loudspeaker (10) which is placed in front of the screen (131) of the video camera. The panel-form loudspeaker can radiate sound when the video tape is played on the screen. Among others, two cases are given to illustrate how the panel-form loudspeaker is mounted on the video camera. FIG. 13*b* shows the first case of installing the transparent panel-form loudspeaker in front of the screen of the video camera. In this case, the frame (18) of the panel-form loudspeaker is adhesively attached to the outer surface of the frame (132) of the screen. FIG. 13*c* shows another installation case in which the flexible suspension device (30) of the transparent panel-form radiator (15) is mounted on the inner surface of the frame (132) of the screen.

FIG. 14*a* shows a PDA (140) equipped with a transparent panel-form loudspeaker (10) which is hung in front of the screen (141) of the PDA. The user can read the information shown on the screen and hear the sound radiated from the transparent panel-form loudspeaker synchronously. Among others, two cases are given to illustrate how the transparent panel-form loudspeaker is mounted on the PDA. FIG. 14*b* shows the first case of installing the transparent panel-form loudspeaker in front of the screen (141) of the PDA. In this case, the frame (18) of the transparent panel-form loudspeaker is adhesively attached to the outer surface of the frame (142) of the screen. FIG. 14*c* shows another installation case in which the flexible suspension device (30) of the transparent panel-form radiator (15) is mounted on the inner surface of the frame (142) of the screen.

I claim:

1. A method of making a transparent panel-form loudspeaker, the loudspeaker comprised of a rectangular transparent panel having a length a and a width b, wherein b is less than or equal to a to be capable of sustaining flexural vibration over an area of the rectangular transparent panel, said method comprising the steps of:

(a) analyzing the distributions of modal parameters, which include natural frequencies, modal amplitudes, mode shapes and phase angles, in the modal analysis of said rectangular transparent panel which is driven by a preselected number of transducers to generate flexural vibration of said rectangular transparent panel and supported peripherally by a flexible suspension device comprised of a continuous corrugated cloth support and several discrete supports, said modal parameters varying according to values of design parameters of said transparent panel-form loudspeaker including a ratio of elastic modulus to density of the material used to fabricate said rectangular transparent panel, a ratio of length to thickness of said rectangular transparent panel, locations of said transducers and discrete supports on a peripheral edge of said rectangular transparent panel;

(b) analyzing a sound pressure level spectrum generated by said transparent panel-form loudspeaker, said sound pressure level spectrum also varying according to the values of said design parameters of said panel-form loudspeaker;

(c) identifying favorable modal parameters which are beneficial to sound radiation and unfavorable modal parameters which have adverse effects on the sound radiation;

(d) selecting the values of said design parameters resulting in suppressing the adverse effects of the unfavorable modal parameters, magnifying beneficial effects of the unfavorable modal parameters, and achieving a desired sound pressure level spectrum over a specific frequency range; and (e) making said rectangular transparent panel of said panel-form loudspeaker with selected values of said design parameters;

wherein said design parameters of the transparent panel-form loudspeaker are selected via a two-level optimization approach in which the ratio of elastic modulus to density and the ratio of length to thickness of the transparent panel are selected to maximize the sound pressure levels at some specific frequencies for the transparent panel-form loudspeaker at a first level of optimization, while locations of said transducers and said discrete supports of the flexible suspension device on a peripheral edge of the rectangular transparent panel are selected to make the panel-form loudspeaker produce more uniform distribution of the sound pressure level in a specific frequency range at a second level of optimization; and wherein said transducers are located at points with distances greater than one tenth of lengths of edges on which the transducers are mounted away from ends of the edges and the distances between supporting points of discrete supports and said transducers are greater than one tenth of the length of the edge on which both said supporting points and the transducers are situated.

2. The method according to claim 1 wherein said transport panel used in fabricating the transparent panel-form loudspeaker is selected to have said ratio of elastic modulus to density greater than 80 and less than 180 GPa/(g/com3) and said ratio of length to thickness greater than 80 and less than 600.

* * * * *